US007013512B1

(12) United States Patent
Hsu

(10) Patent No.: US 7,013,512 B1
(45) Date of Patent: Mar. 21, 2006

(54) COMBINATION PRESSURE RELEASE ERGONOMIC PILLOW

(76) Inventor: Ming-Hui Hsu, c/o PMB#1008, 1867 Yqnacio Rd., Walnut Creek, CA (US) 94598

( * ) Notice: Subject to any disclaimer, the term of this patent is extended or adjusted under 35 U.S.C. 154(b) by 0 days.

(21) Appl. No.: 10/996,422

(22) Filed: Nov. 26, 2004

(51) Int. Cl.
*A47G 9/00* (2006.01)

(52) U.S. Cl. ..... 5/636

(58) Field of Classification Search ..... 5/636, 5/639, 640, 643, 645
See application file for complete search history.

(56) References Cited

U.S. PATENT DOCUMENTS 4,916,765 A * 4/1990 Castronovo, Jr. ..... 5/640
5,533,218 A * 7/1996 Fahy ..... 5/636
5,682,633 A * 11/1997 Davis ..... 5/636
5,937,460 A * 8/1999 Humphries ..... 5/640
6,345,401 B1 * 2/2002 Frydman ..... 5/636
2001/0029630 A1 * 10/2001 Cortese et al. ..... 5/636

* cited by examiner

*Primary Examiner*—Alexander Grosz
(74) *Attorney, Agent, or Firm*—Leong C. Lei

(57) ABSTRACT

A combination pressure release ergonomic pillow comprised of a body of the pillow having its top surface in a curve complying with ergonomic requirements of the human head and neck, a channel on one side or multiple channels on both sides, a slot at bottom of the body of the pillow, and insert(s) to be inserted into the channel(s); and a support inserted into the slot to support the back of head of the user; the insert being retractable to adjust the height of the pillow body to define optimal pressure release curve according to the individual user to protect the cervical vertebrae of the user.

3 Claims, 15 Drawing Sheets

COMBINATION PRESSURE RELEASE ERGONOMIC PILLOW

BACKGROUND OF THE INVENTION (a) Technical Field of the Invention

The present invention is related to a combination pressure release ergonomic pillow, and more particularly, to one that defines the optimal comforts depending on the individual user.

(b) Description of the Prior Art

On average, people spend one third of their lifetime in sleeping (eight hours per day). The importance of choosing a good pillow meeting ergonomic standards to improve sleeping quality is elf-explanatory. The standard pillow fails to properly support one's cervical vertebrae, which can result in deformation, and also the standard pillow lacks certain massage effects. Quality sleep essentially depends on whether the seven cervical vertebrae (C1~C7) are comfortably resting on the pillow.

Certain pressure release pillows have claimed to provide support effects and cervical vertebrae protection generally. These are available in the market and are usually designed with a simple arc top surface for the head and the neck of the user to rest on to achieve the support results. However, the degree of the arc and the height of those pillows are fixed to prevent any adjustment; and there is the absence of any channel designed to release the pressure. Accordingly, in the case of a user who has lighter and smaller head, her/his cervical vertebrae are over supported due to less deformation of the support arc. The head of the user tends to lean back which causes a sore neck. On the other hand, if the user has a heavier head long neck, the support arc of the top of the pillow is subject to greater deformation and result in comparatively lower support to the cervical vertebrae, thus the head tends to lean forward and the throat retreats to compress the nerves of the cervical vertebrae. In either case, the pillow makes its user very uncomfortable. Those pillows, which ergonomically fail to adapt to the individual user due to noncompliance with head and neck in the design of construction, actually do not provide any results of pressure release.

Referring to FIG. 14 of the accompanying drawings, a pillow 80 of the prior art has disposed at its bottom a slot for deformation when the head of the user rests upon it. However, the height of the pillow cannot be adjusted depending on the size of the head and the neck of the individual user, thus failing to define a comfortable pressure release curve for the individual user. Furthermore, there is the absence of a support for the back of head of the user.

As illustrated in FIG. 15, another pillow 90 of the prior art has disposed at its bottom multiple corrugated laminates 91 each retractable for the adjustment of the height of the pillow. Whereas, the dimension of each laminate 91 is the same as that of the body of the pillow, the construction is much complicated and incurs higher production cost. Furthermore, since upon adjusting the height of the pillow the laminate 91 is retracted or inserted in one piece, it lacks variations in the adjustment of the height of the pillow 90.

SUMMARY OF THE INVENTION

The primary purposes of the present invention is to provide a combination pressure release pillow that permits diversified adjustment to height and ergonomically designed to make one's head and neck comfortable while sleeping. To achieve the purpose, the top of the pillow is provided with protrusions to compromise the head and the cervical vertebrae. One or both sides of the body of the pillow are provided with a channel; an insertion to be inserted into the channel or placed beneath the pillow is provided depending on the size of the head and the neck of the user. Six or more heights are adjustable on both sides of the body of the pillow by inserting or separating the insert into or from the channel to define the optimal comfort pressure release curve for the individual user.

Another purpose of the present invention is to provide a combination pressure release pillow having on both sides of its top a higher protrusion and a lower protrusion connected by a recess. Multiple slots are respectively provided on the higher protrusion, the lower protrusion, and the recess to better comply with the ergonomics of the human head and neck, thus to prevent possible injury to cervical vertebrae which results from being under- or over-supported. Those slots provided ventilation and pressure release by deformation to define the optimal comfort pressure release curve for the individual user.

Yet another purpose of the present invention is to provide a combination pressure release pillow that massages one's head and neck by providing multiple ribs on the larger protrusion, the lower protrusion, and the recess to properly hold against the cervical vertebrae of the user.

Still another purpose of the present invention is to provide a combination pressure release pillow that supports the back of the head of the user by having disposed at the bottom of the body of the pillow a slot to contain a bearing member.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
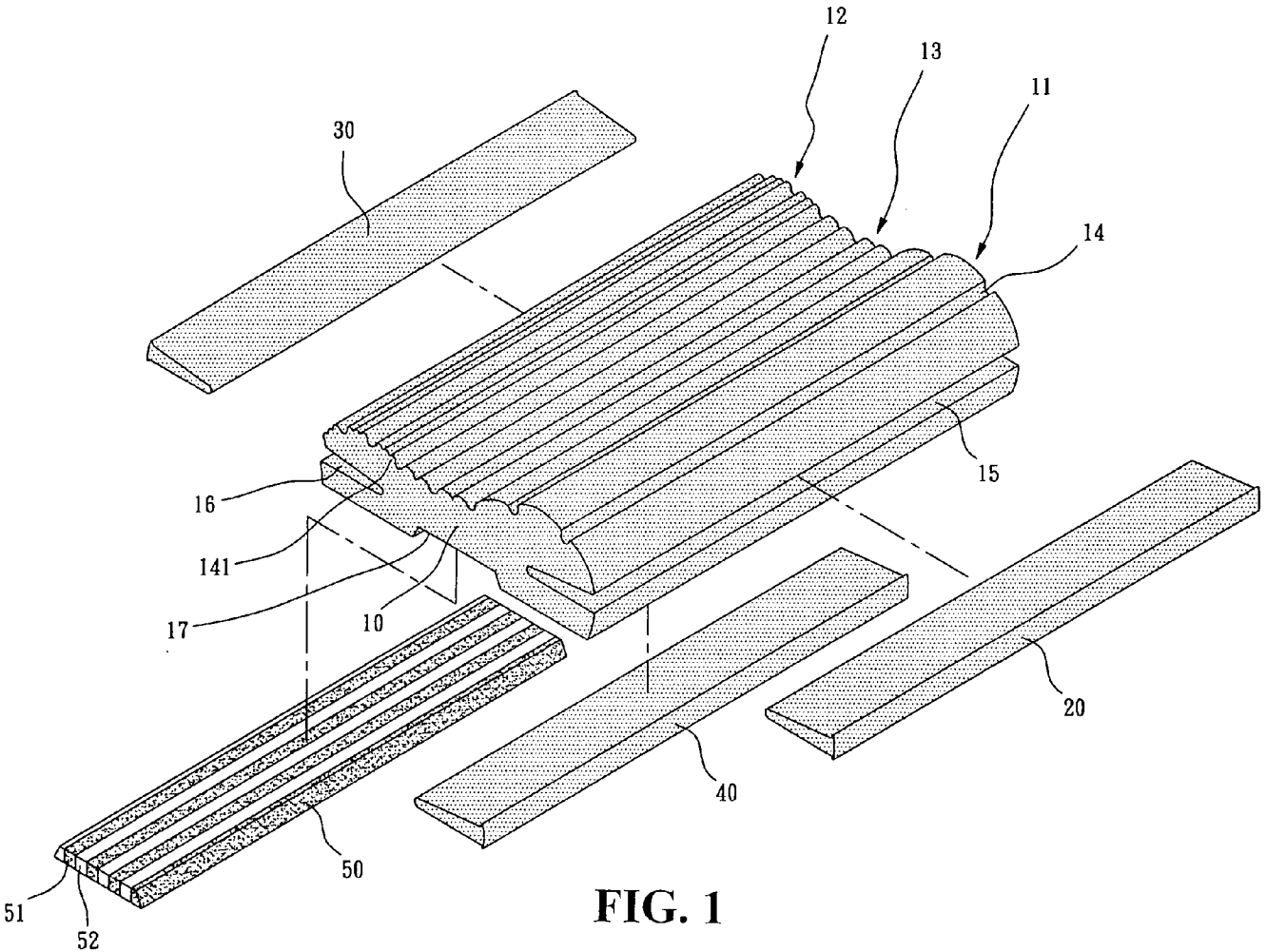
FIG. 1 is an exploded view of the present invention.
Figure 2:
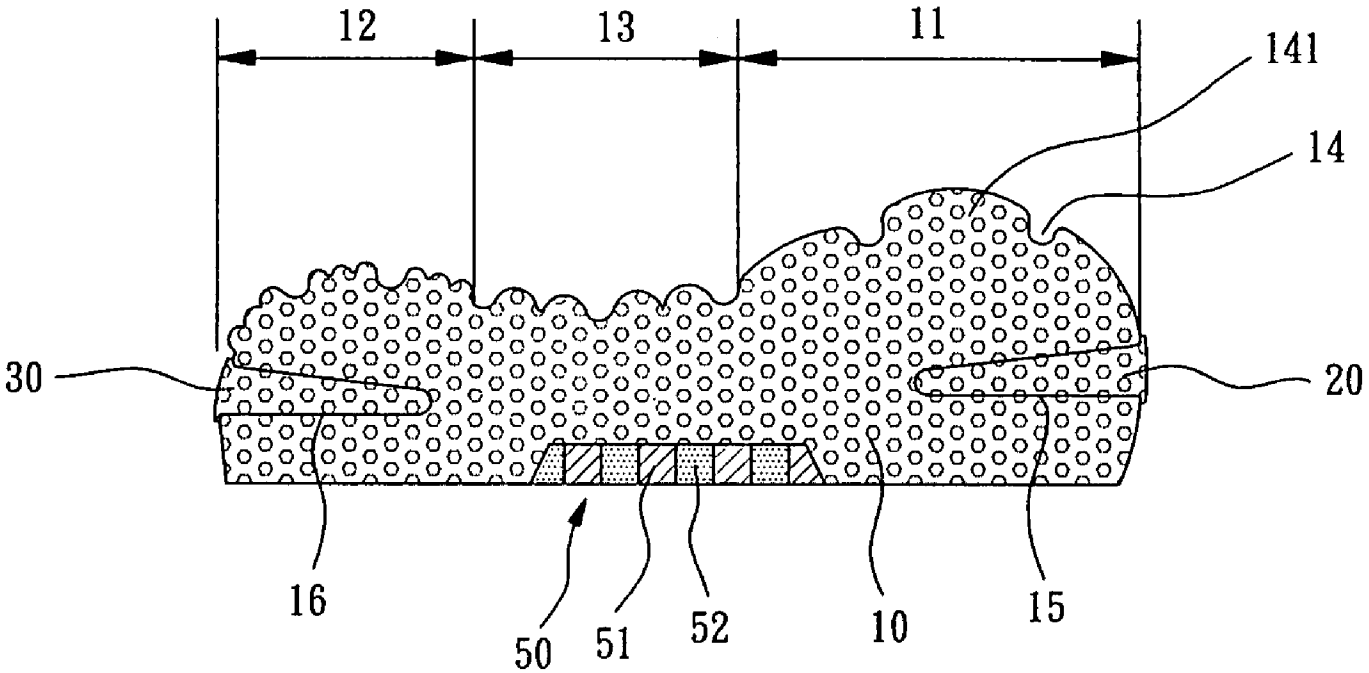
FIG. 2 is a sectional view of the present invention.

Referring to FIGS. 1 and 2, the present invention is essentially comprised of a body 10 to release the pressure from the cervical vertebrae of the user; a first insert 20, the second insert 30, and the third insert 40 to combine with or retract from the body 10 for the adjustment of the height of the body 10; and a panel 50 provided beneath the body 10 to support the back of the head of the user. Wherein, the body 10 is made of memory foam, or natural emulsion admixed with fragrant components including lavender, rose, phytoncidere, etc.), and then covered up with pillowcase. The top surface of the body 10 is designed with an ergonomically compliant curve. The curve is divided into three portions, respectively, a higher protrusion 11, a lower protrusion 12, and a recess 13 connecting both of the higher and the lower protrusions 11, 12. The higher protrusion 11 is designed for a user with a long neck to rest on. The lower protrusion 12 is designed for a user with a short neck to rest on. And the recess 13 is designed for the parietal bone of the user to rest on. Multiple slots 14 and multiple ribs 141 in different diameters to release the pressure are provided on the higher protrusion 11, the lower protrusion 12, and the recess 13. Each slot 14 is designed with the same depth. Those ribs 141 on the higher protrusion are bigger and those on the lower protrusion 12, smaller. Every three ribs 141, bigger or smaller, provided on the higher and the lower protrusions 11, 12 are followed with a slot 14 that separates each protrusion which, effectively supports and protects the cervical vertebrae of the individual user. Those ribs 141 each made in size between that on the higher and the lower protrusions 11, 12, on the recess 13 are provided for the parietal bone of the user to rest on, and subject to a force at a degree between that respectively applied upon the higher protrusion 11 and the lower protrusion 12. A slot 14 for separation purposes follows every two ribs 141 provided on the recess 13. Both sides of the body 10 are respectively provided with a first channel 15 and a second channel 16 in any form for the insertion of the first and the second inserts 20, 30; and a slot 17 is provided at the bottom of the body 11 to receive the panel 50.

Both of the first and the second inserts 20, 30 are respectively cut from the first and the second channels 15, 16 thus are of the same material as that of the body 10; or alternatively made of other resilient or hard materials to be respectively inserted into the first and the second channels 15, 16. Both of the first and the second inserts 20, 30 are made in any form, which can be carefully inserted into the first and the second channels 15, 16.

The third insert 40 is an accessory separately provided and is an optional item made of a material same as that of the body 10 or any other resilient or hard material to be placed beneath the body 10.

The panel 50 includes multiple soft parts 51 and multiple hard parts 52 alternatively arranged to provide the support strength expected; or may be comprised of strictly soft parts 51 or hard parts 52.

Figure 3:
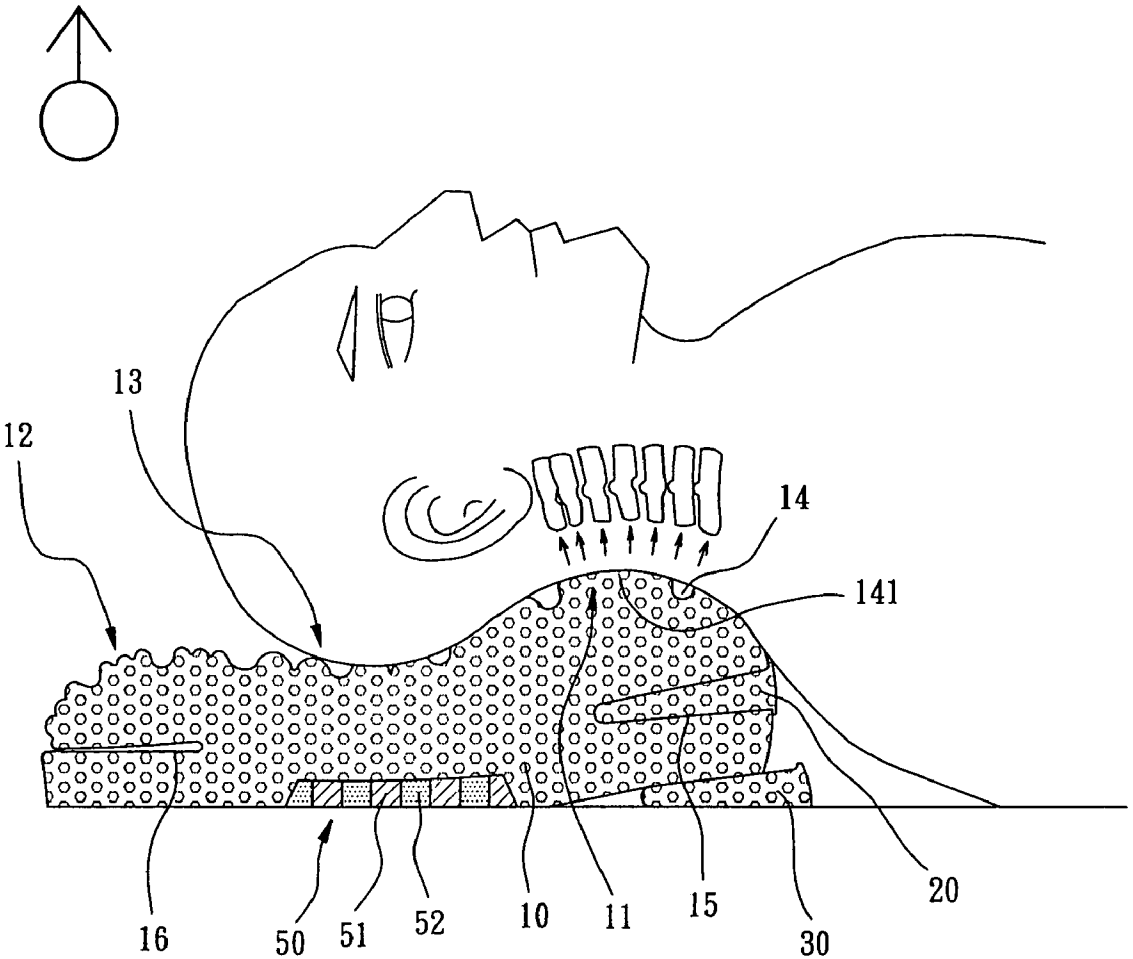
FIG. 3 is a side view showing a user status of the higher protrusion of present invention.

As illustrated in FIG. 3, the higher protrusion 11 of the body 10 is designed for a user with a heavier head and longer neck. When the second insert 30 is inserted at the lower protrusion 12, it increases the height of the pillow. The recess 13 is provided for the parietal bone of the user to rest on. The panel 50 merely supports the back of the head to prevent the recess 13 from collapsing due to the pressure applied upon it. Those slots 14 offer ventilation and pressure release by deformation for the cervical vertebrae resting upon the body 10. Though the curve of the higher protrusion 11 will be deformed by not to such an extent of collapsing as observed with the prior art. Those slots 14 by compromising the curve of the higher protrusions 11 define the optimal comfort pressure release depending on the head and the neck of the individual user to release the pressure by deformation according to the shape and weight of the head and the neck of the user, thus to prevent the cervical vertebrae of the user from being hurt due to staying too low. Meanwhile, those ribs by properly holding against the head and the neck of the user provide massage function.

Figure 4:
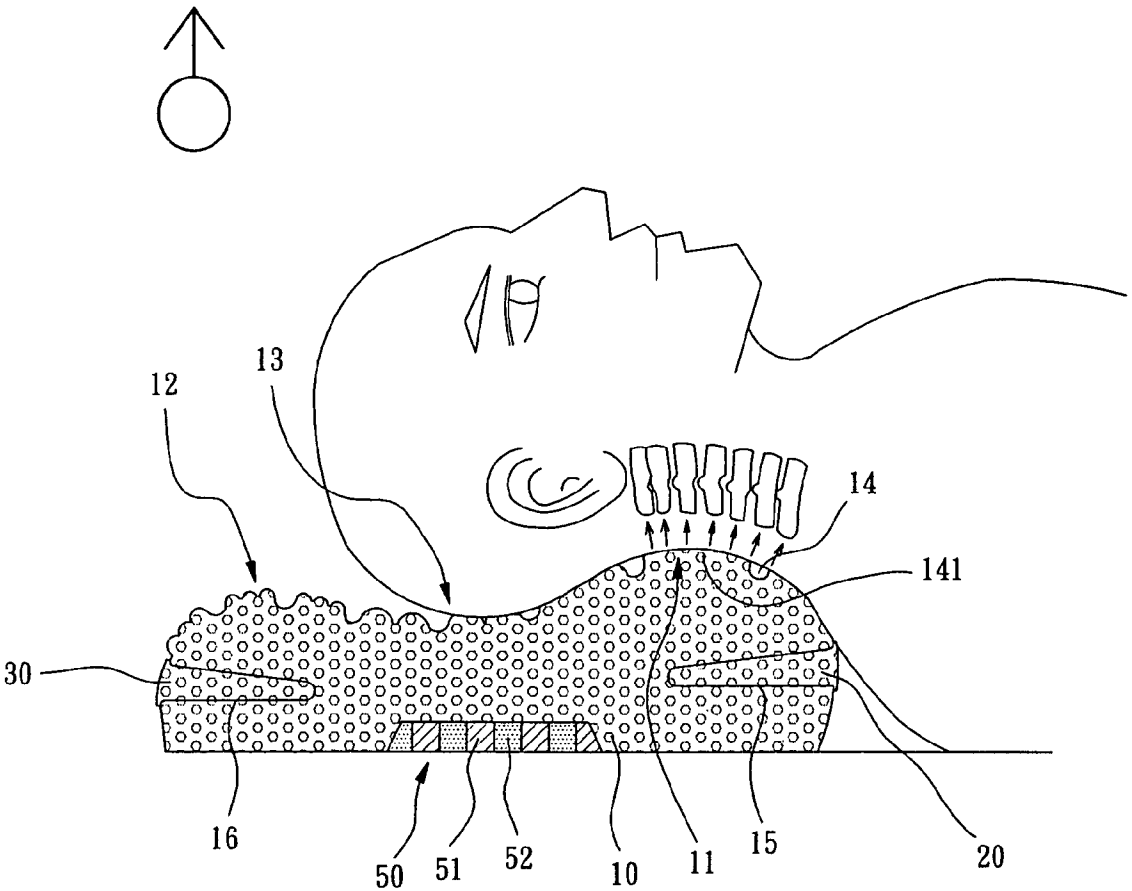
FIG. 4 is a side view showing another use status of the higher protrusion of present invention.
Figure 5:
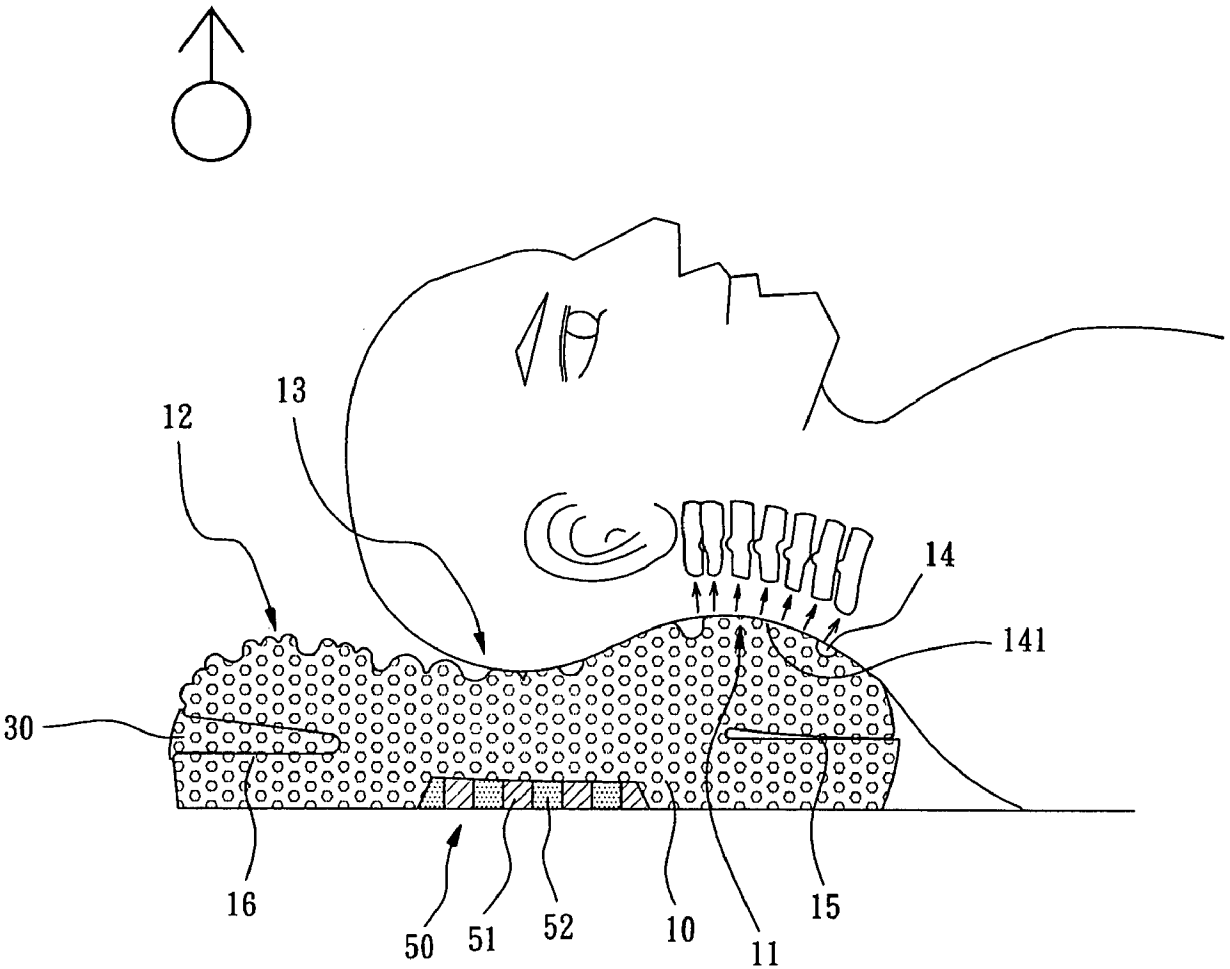
FIG. 5 is a side view showing another use status yet of the higher protrusion of present invention.

If the support to the cervical vertebrae feels too high by the user resting his head upon the higher protrusion 11 of the body 10, the second insert 30 below the higher protrusion 11 can be removed and inserted into the second channel 16, or the first insert 20 can be removed from the body 10, see illustration in FIGS. 4 and 5 for adjusting the support height. That is, with the first insert 20 fully placed into the first channel 15 and the second insert 30 placed below the higher protrusion 11, the higher protrusion 11 is at its maximal height; with the first insert 20 fully placed into the first channel 15, at its intermediate height; and with the first insert 20 fully removed from the first channel 15, at its minimum height. Of course, depending on the individual user's preference, the first insert 20 may be inserted into any location of the first channel 15 without affecting the flexible adjustment of the pressure release curve in use.

Figure 6:
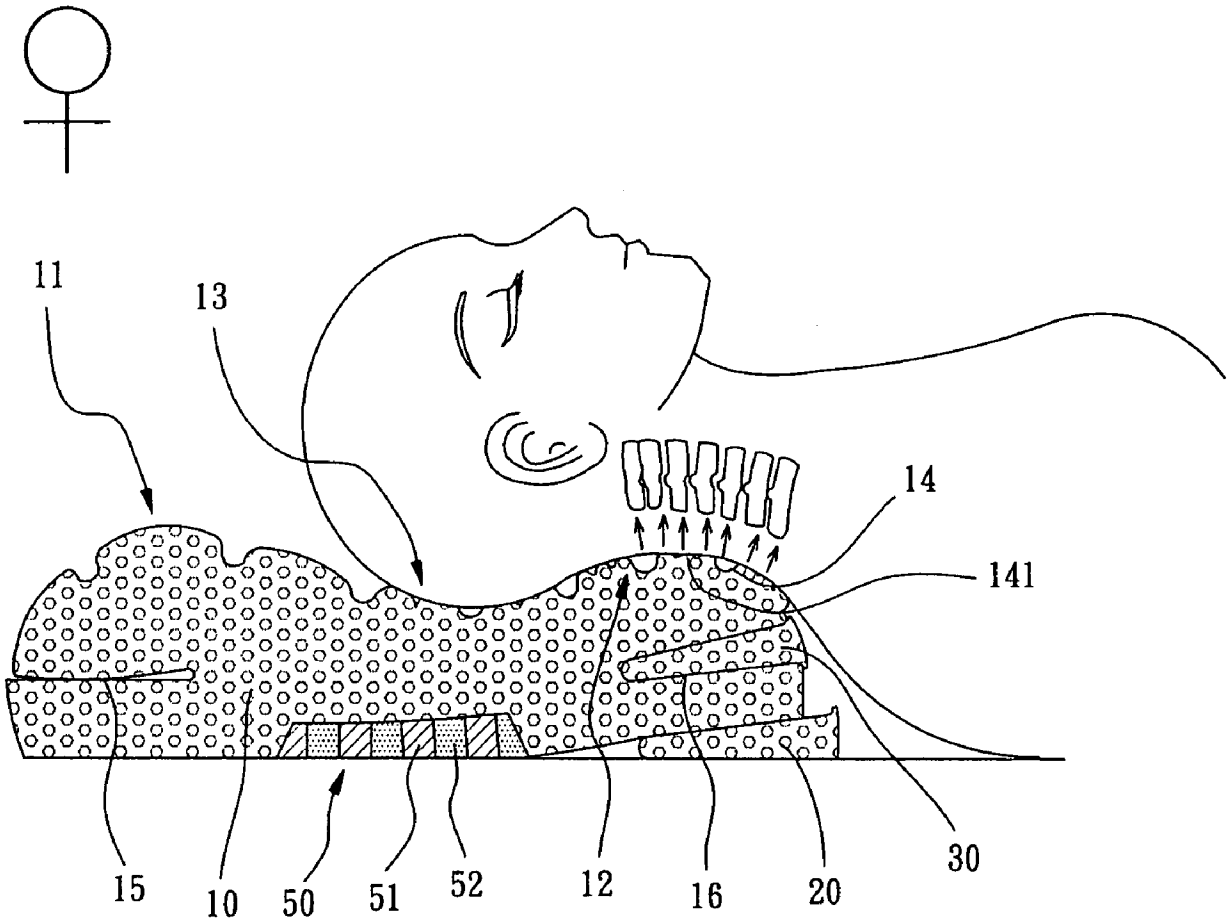
FIG. 6 is a side view showing a use status of the lower protrusion of present invention.

As illustrated in FIG. 6, the lower protrusion 12 of the body 10 is provided for the user with a shorter neck to rest on. Meanwhile, the first insert 20 of the higher protrusion 11 is placed below the lower protrusion 12 to increase the height of the pillow. The recess 13 is provided for the parietal bone of the user to rest on, and the panel 50 merely supports the back of the head to prevent the recess 13 from over collapsed due to the pressure applied upon it. Those slots 14 offer ventilation and pressure release by deformation for the cervical vertebrae resting upon the body 10. Though the curve of the lower protrusion 12 will be slightly deformed but at an extent less than that observed with the higher protrusion 11. Those slots 14 by compromising the curve of the lower protrusions 12 define the optimal comfort pressure release depending on the head and the neck of the individual user to release the pressure by deformation according to the shape and weight of the head and the neck of the user, thus to prevent the cervical vertebrae of the user from being hurt due to staying too high.

Figure 7:
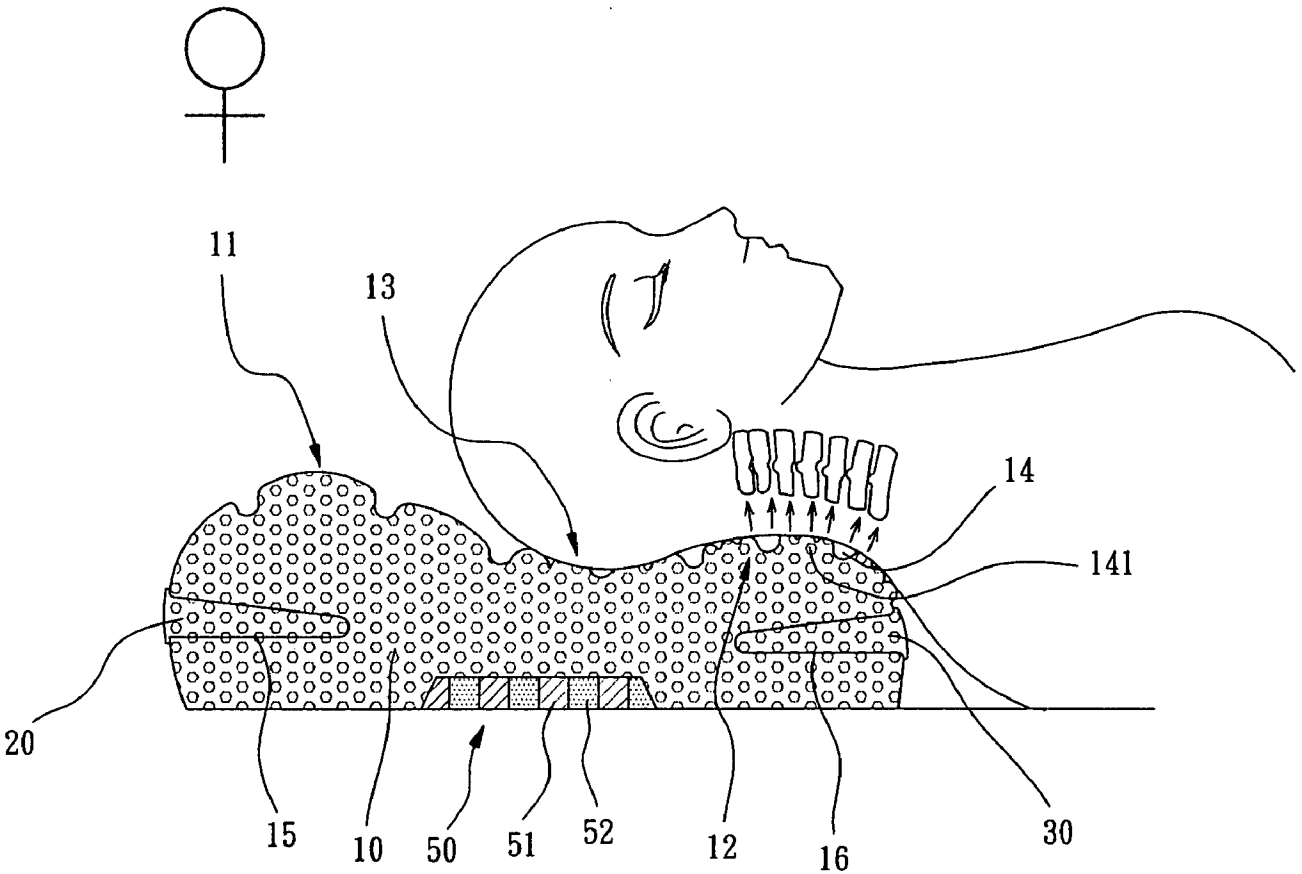
FIG. 7 is a side view showing another use status of the lower protrusion of present invention.
Figure 8:
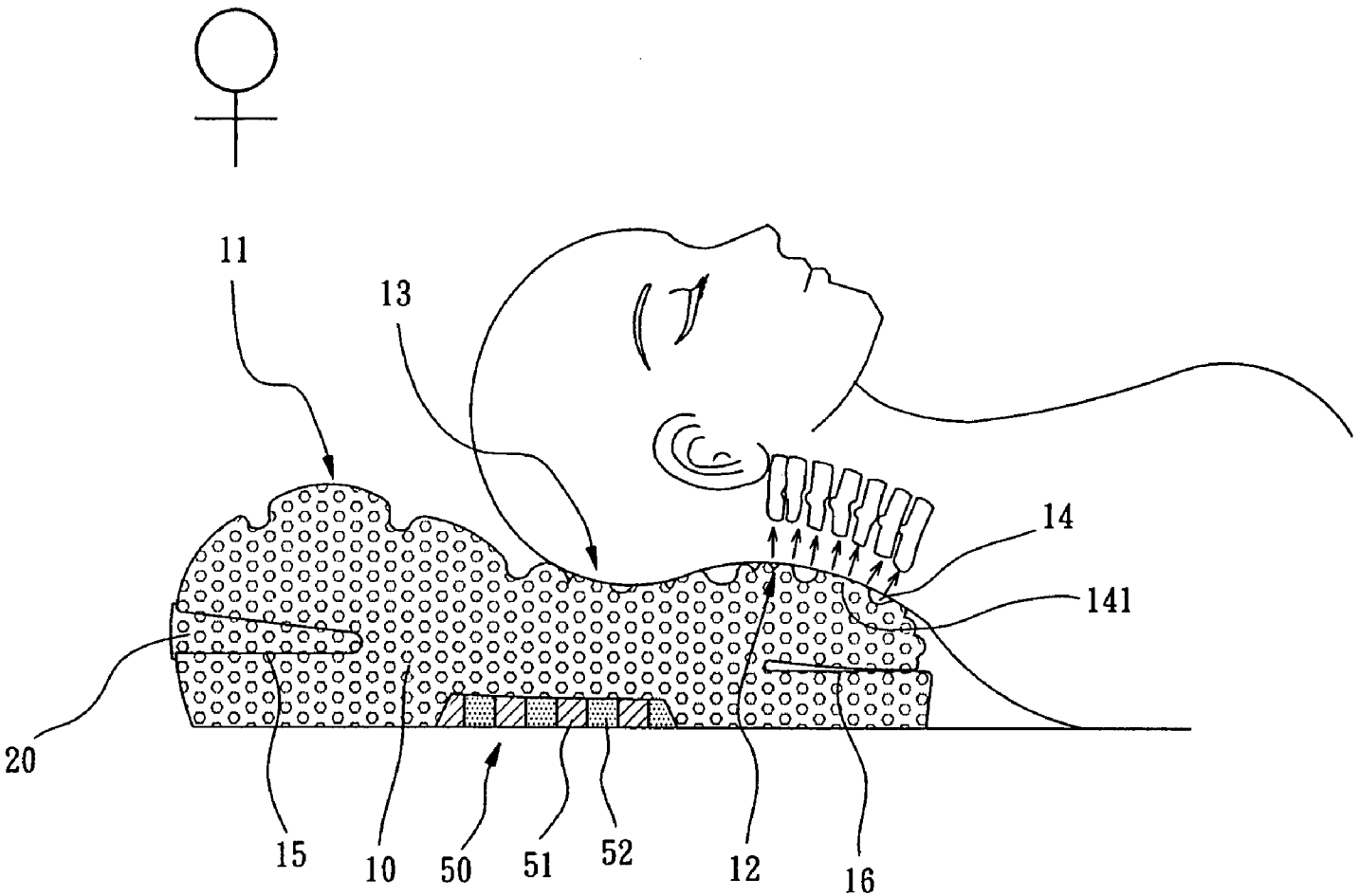
FIG. 8 is a side view showing another use status yet of the lower protrusion of present invention.

If the support to the cervical vertebrae feels too high by the user resting his head upon the lower protrusion 12 of the body 10, the first insert 20 below the lower portion 12 is removed and inserted into the second channel 16, or the second insert 30 is removed from the body 10 since the second insert 30 is merely located at where below the lower protrusion 12 as illustrated in FIGS. 7 and 8 to adjust the support height. This is, with the second insert 30 fully placed into the second channel 16 and the first insert 20 placed below the lower protrusion 12, the lower protrusion 12 is at its maximal height; with the second insert 30 fully placed into the second channel 16, at its intermediate height; and with the second insert 30 fully removed from the second channel 16, at its minimum height. Of course, depending on the individual user preference, the second insert 30 may be inserted into any location of the second channel 16 without affecting the flexible adjustment of the pressure release curve in use.

The surface each of the first and the second inserts 20, 30 may be provided with a proper slope to facilitate their insertion or removal from the first and second channels 15, 16 and their travel in the first and the second channels 15, 16.

The higher protrusion 11, and the lower protrusion 12 to the body 10 of the pillow of the present invention offers multiple heights for adjustment (at least six, three on each side) through the insertion and removal of the first and the second inserts 20, 30 into and from the first and the second channels 15, 16.

In general, the present invention by means of the adjustment structure and the shape and material of the members achieves the perfect and comfortable pressure release.

Figure 9:
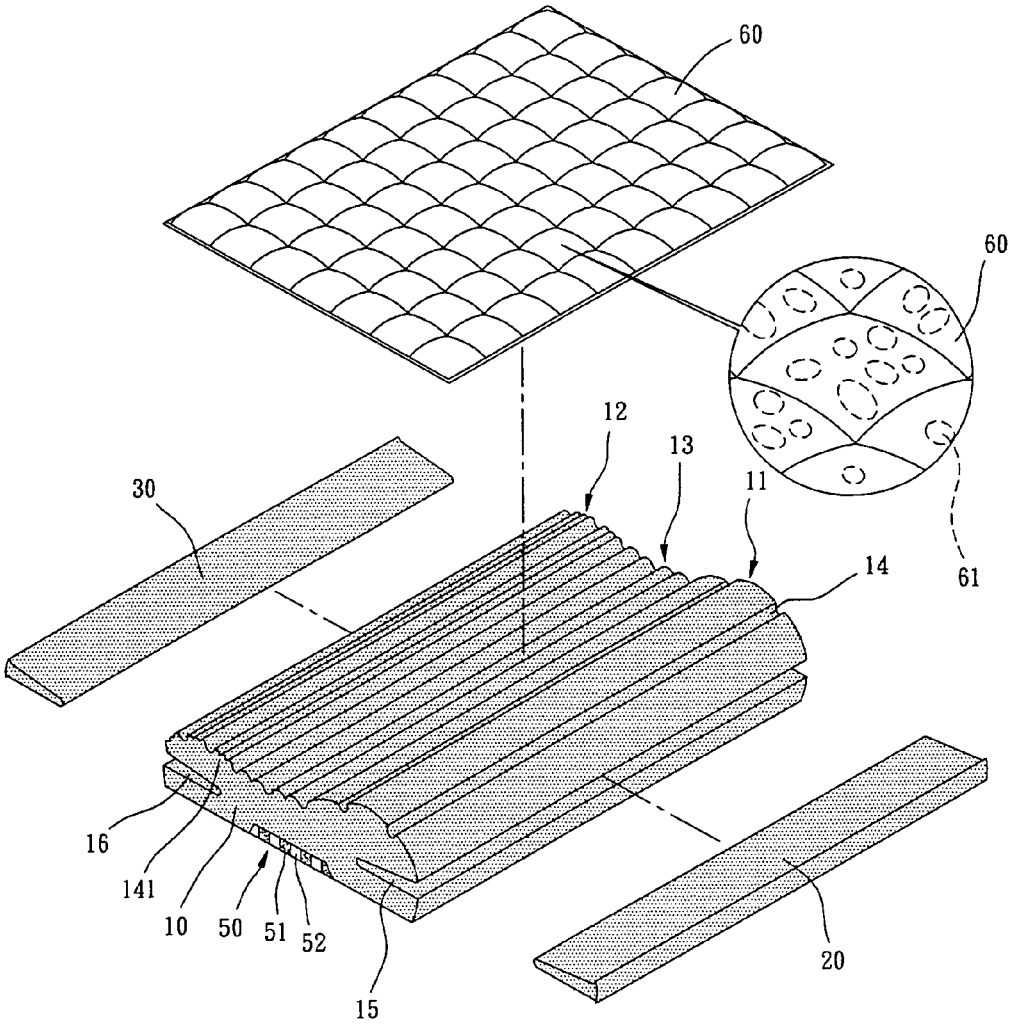
FIG. 9 is an exploded view of the present invention with an additional pad.
Figure 10:
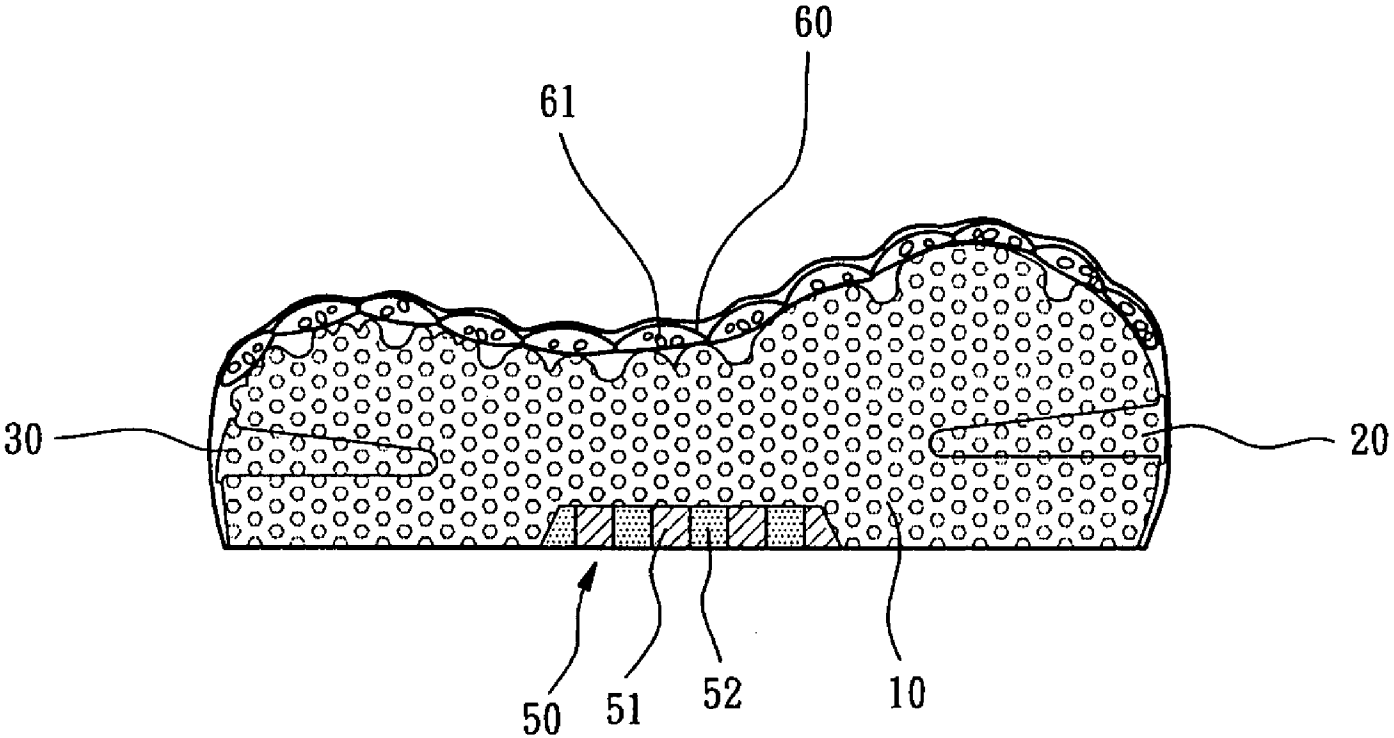
FIG. 10 is a schematic view showing the present invention is covered with a pillowcase.

Now referring to FIGS. 9, and 10, a soft pad 60 is paved on the surface of the body 10. The body 10 is contained in a pillowcase for appearance effects. The pad 60 may contain crystal, jade, magnetic stone, or other mineral stone 61 to provide extra health maintenance results to one's head and cervical vertebrae resting upon the body 10.

Figure 11:
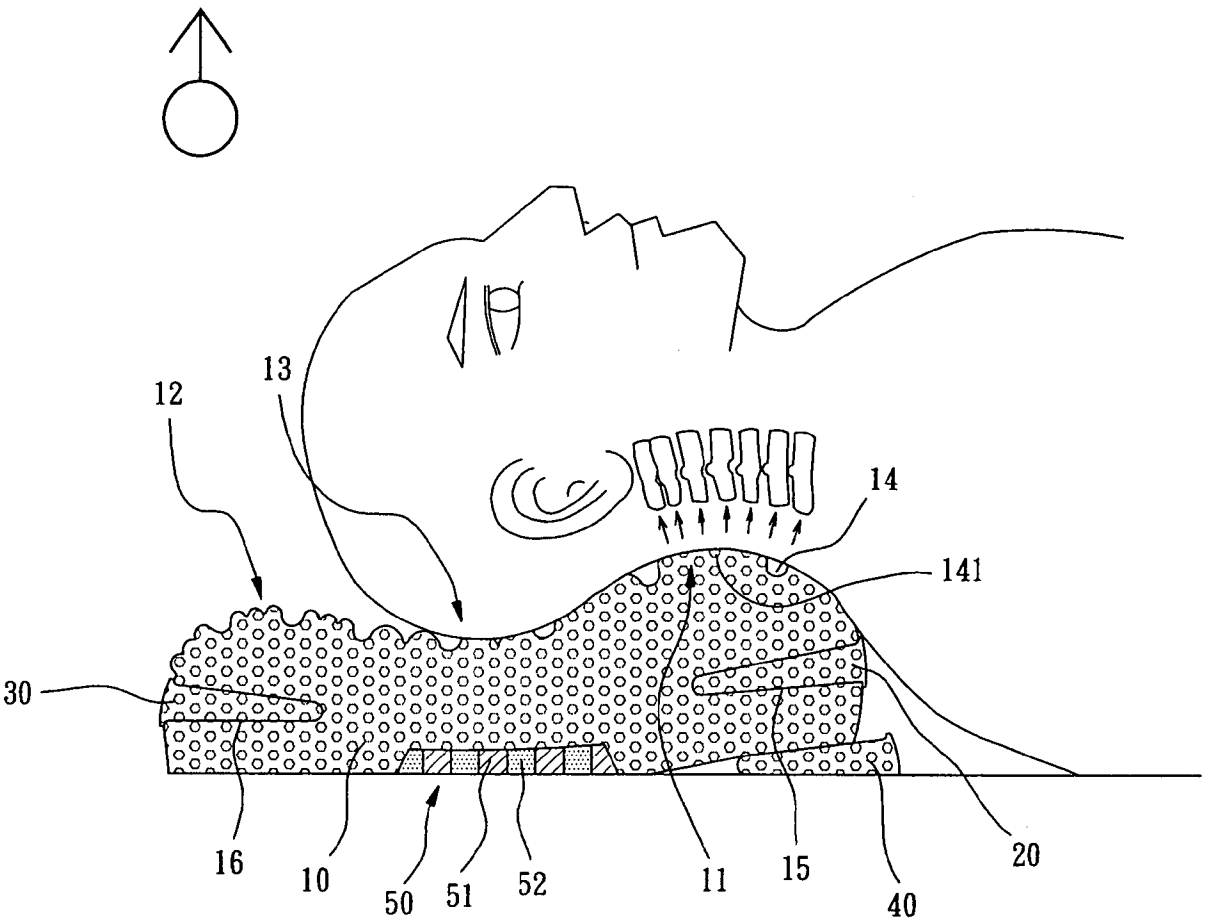
FIG. 11 is a schematic view showing that a third insert is placed beneath the body of the pillow of the present invention.

As illustrated in FIG. 11, the third insert 40 is directly placed beneath the higher protrusion 11 (or beneath the lower protrusion 12, not illustrated) without removing the first and the second inserts 20, 30 from the body 10 to add more options for height adjustment of the pillow.

Figure 12:
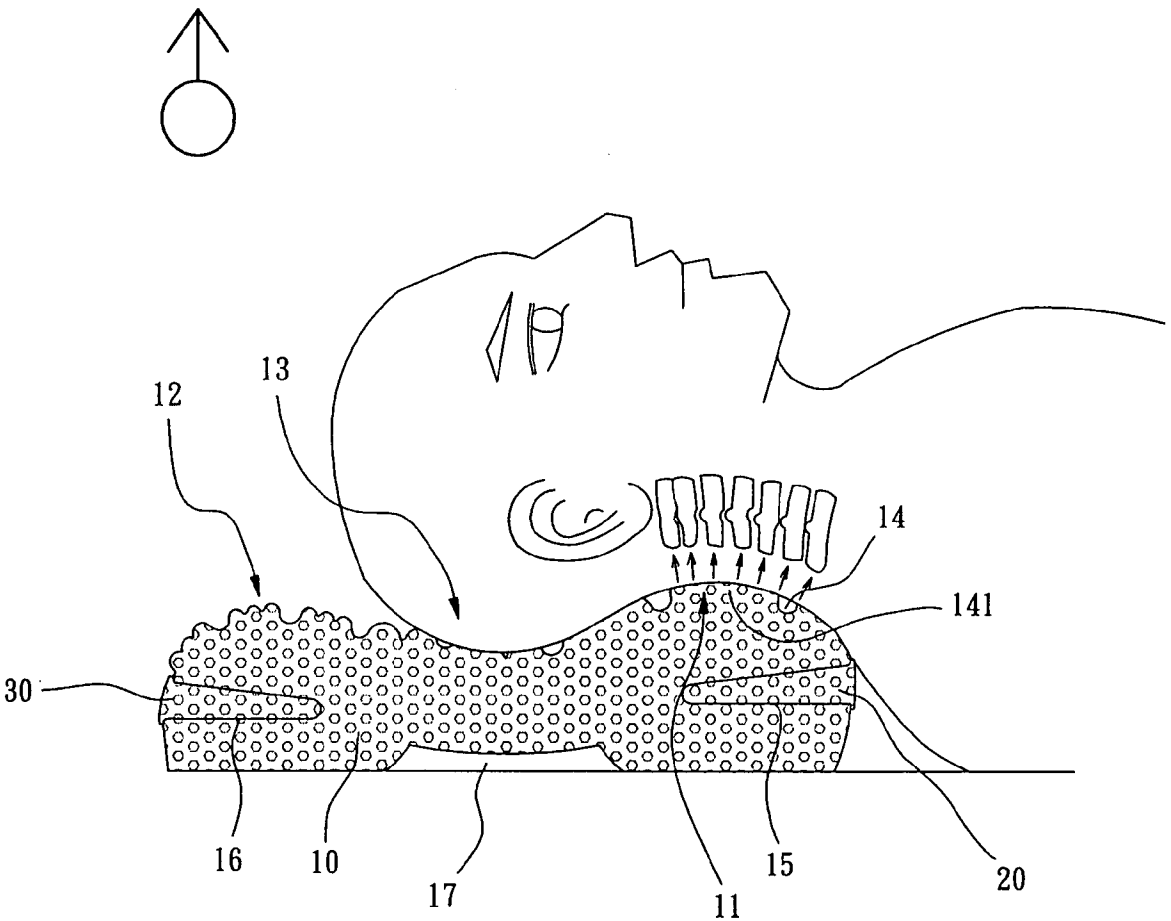
FIG. 12 is a schematic view showing that a panel is removed from the body of the pillow of the present invention.

Whereas the panel 50 is movable provided to the body 10 as illustrated in FIG. 12, the user may remove the panel 50 depending on personal needs.

Figure 13A:
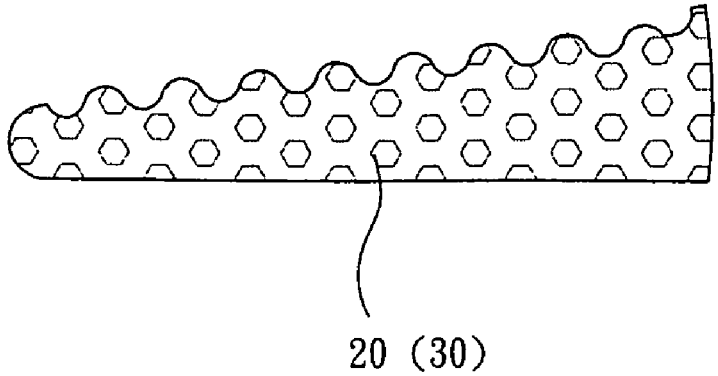
FIGS. 13*a* and 13*b* are schematic view showing both of a first and a second inserts of the present invention are made in different shapes.
Figure 13B:
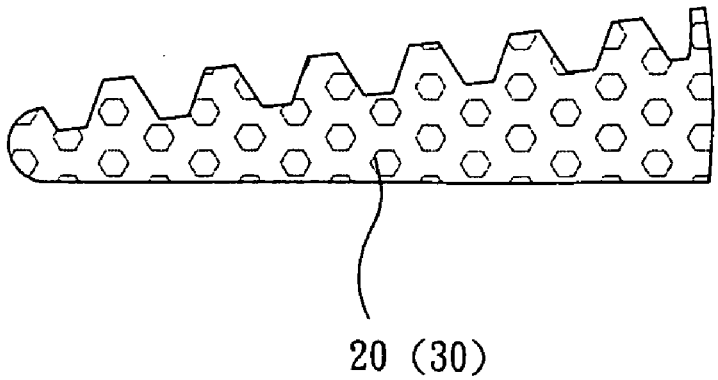
Figure 14:
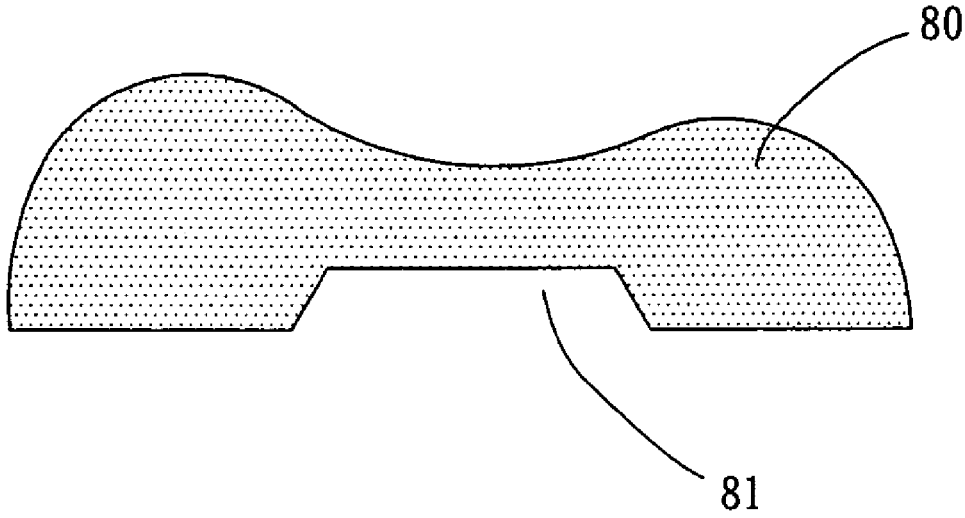
PRIOR ART FIG. 14
FIG. 14 is a schematic view showing the prior art is in use.
Figure 15:
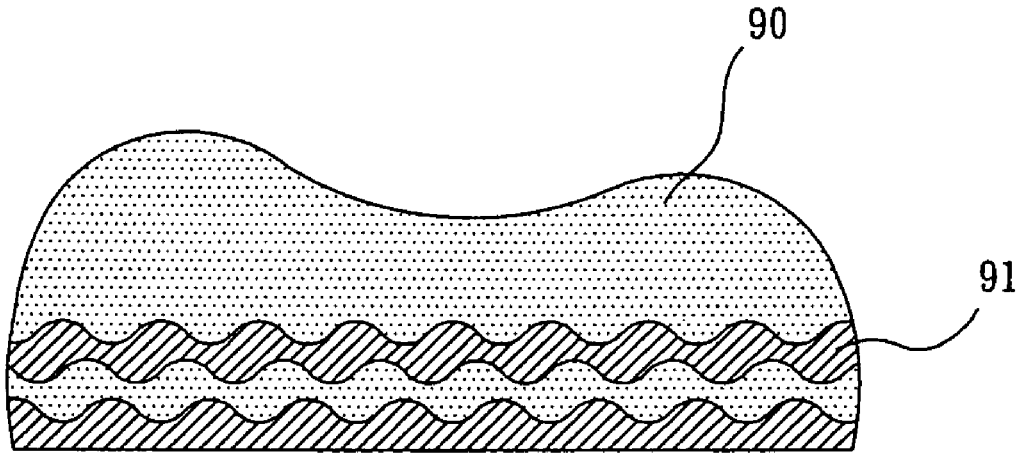
PRIOR ART FIG. 15
FIG. 15 is another schematic view showing the prior art is in use.

Both of the first and the second inserts 20,30 of the present invention may be made in any form, e.g., corrugated or serrated as illustrated in FIG. 13. Both of the first and the second channels 15, 16 of the body 10 in conjunction with the shape of the first and the inserts 20, 30 further provide different results of pressure release while both of the first and the second inserts 20, 30 achieve different pressure release results depending on the materials used for the manufacturing of both first and second inserts 20, 30.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A combination pressure release ergonomic pillow comprising:

a body having a top provided with a curved surface, said curved surface having a first protrusion, a second protrusion which is higher than said first protrusion, and a recess between said first and second protrusions, said curved surface being formed with a plurality of slots and ribs, said body having two opposite sides formed with a first channel under said first protrusion and a second channel under said second protrusion, said body having a bottom formed with a slot engaged with a panel, said panel having a plurality of sot parts and hard parts alternatively arranged;

a first insert configured to be engageable with said first channel in order to adjust height of said first protrusion; and a second insert configured to be engageable with said second channel in order to adjust height of said second protrusion.

2. The combination pressure release ergonomic pillow as claimed in claim 1, wherein said body is made of memory foam.

3. The combination pressure release ergonomic pillow as claimed in claim 1, wherein said body is made of natural emulsion.

* * * * *